US010547113B2

(12) United States Patent
Roos et al.

(10) Patent No.: US 10,547,113 B2
(45) Date of Patent: Jan. 28, 2020

(54) BLIND MATE WAVEGUIDE FLANGE USABLE IN CHIPSET TESTING

(71) Applicant: Roos Instruments, Inc., Santa Clara, CA (US)

(72) Inventors: Mark Roos, San Carlos, CA (US); Rick Rodriguez, Brentwood, CA (US); Ray Beers, San Jose, CA (US)

(73) Assignee: Roos Instruments, Inc., Santa Clara, CA (US)

( * ) Notice: Subject to any disclaimer, the term of this patent is extended or adjusted under 35 U.S.C. 154(b) by 60 days.

(21) Appl. No.: 15/828,199

(22) Filed: Nov. 30, 2017

(65) Prior Publication Data

US 2019/0165479 A1 May 30, 2019

(51) Int. Cl.

| | |
|---|---|
| ***H01Q 13/06*** | (2006.01) |
| ***H01P 5/18*** | (2006.01) |
| ***H01P 5/08*** | (2006.01) |
| ***H01P 1/04*** | (2006.01) |

(52) U.S. Cl.

CPC ..... *H01Q 13/065* (2013.01); *H01P 1/042* (2013.01); *H01P 5/082* (2013.01); *H01P 5/183* (2013.01)

(58) Field of Classification Search

CPC ..... H01P 1/042; H01P 5/082

USPC ..... 333/254, 21 R

See application file for complete search history.

(56) References Cited

U.S. PATENT DOCUMENTS

| | | | | |
|---|---|---|---|---|
| 2,837,723 A * | 6/1958 | Krantz et al. | ..... | H01P 1/042 174/21 R |
| 4,540,959 A * | 9/1985 | Saad | ..... | H01P 5/082 333/21 R |
| 6,583,693 B2 * | 6/2003 | Paynter et al. | ..... | H01P 5/082 333/254 |
| 7,592,887 B2 * | 9/2009 | Chao et al. | ..... | H01P 1/042 333/254 |

* cited by examiner

*Primary Examiner* — Benny T Lee

(57) ABSTRACT

A blind mate waveguide flange includes a mating surface for interfacing with a waveguide probe interface. The mating surface includes a choke flange and a first opening to one end of a waveguide transition section. The choke flange includes a choke groove separating a peripheral region of the mating surface from an inner region of the mating surface. The inner region is recessed relative to the peripheral region to provide an air gap upon mating with another mating surface. The first opening has a first shape. The blind mate waveguide flange further includes a waveguide connection interface that includes a second opening at an opposite end of the waveguide transition section for interfacing with a waveguide. The second opening has a second shape such that the waveguide transition section provides a transition from the first shape to the second shape.

27 Claims, 7 Drawing Sheets

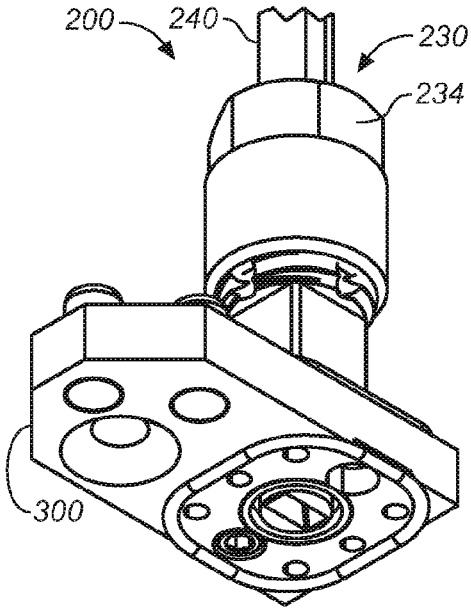
FIG. 3A
FIG. 3B
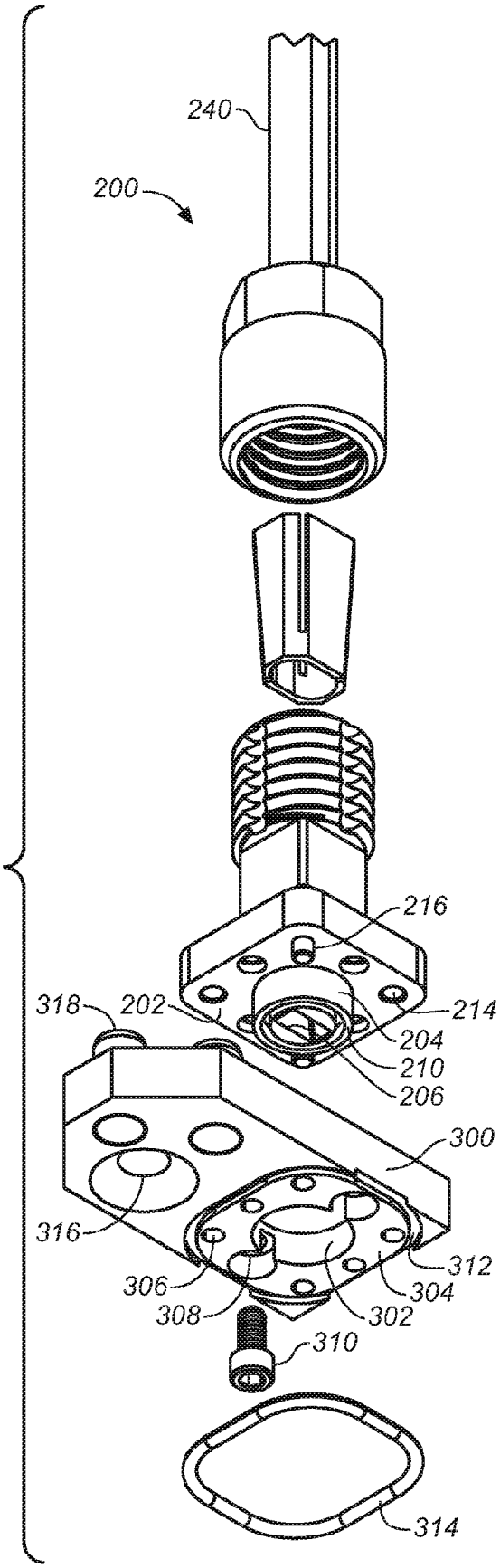

BLIND MATE WAVEGUIDE FLANGE USABLE IN CHIPSET TESTING

BACKGROUND

Automotive applications are requiring increased use of RF/microwave frequency bands, from low RF signals through millimeter-wave frequencies at 77 GigaHertz (GHz). As these high-frequency signals become more integral parts of the worldwide driving experience, effective test solutions become more critical for designers developing new automotive RF/microwave circuits, as well as production facilities seeking efficient methods for verifying the performance of these added circuits. While lower-frequency testers are in abundance, and automotive applications employ a wide range of wireless frequencies—including remote keyless entry (RKE) systems at 433 and 868 MHz—a growing concern in automotive markets is for the accurate and cost-effective testing of 77 GHz automotive radar systems. This interest stems from the fact that historically, measurement equipment at such high frequencies has neither been commonplace nor cost-effective.

A number of different automotive radar-based safety applications make use of frequencies from 76 to 77 GHz, for adaptive cruise control (ACC), blind-spot detection (BSD), emergency braking, forward collision warning (FCW), cross-traffic alert (CTA), lane change assist (LCA), and rear collision protection (RCP). For example, in a collision warning system, an automotive radar sensor can detect and track objects within the range of the transmitted and returned radar signals, automatically adjusting a vehicle's speed and distance in accordance with the detected targets. Different systems can provide a warning of a potential collision ahead and also initiate procedures leading to emergency braking as required.

BRIEF DESCRIPTION OF THE DRAWINGS

The accompanying drawings, which are incorporated in and form a part of the Detailed Description, illustrate various embodiments of the subject matter and, together with the Detailed Description, serve to explain principles of the subject matter discussed below. Unless specifically noted, the drawings referred to in this Brief Description of Drawings should be understood as not being drawn to scale. Herein, like items are labeled with like item numbers.

FIGS. 2A-2E depict various views of a blind mate waveguide flange, according to some embodiments, wherein FIG. 2A shows a front, or face, view of the flange, FIG. 2B shows a cross-sectional view of the flange connected to a waveguide, FIG. 2C shows a perspective view of the flange connected to the waveguide, FIG. 2D shows an exploded view of FIG. 2C, and FIG. 2E snows a rear view of the flange.

FIGS. 3A-3C depict views of a blind mate waveguide flange connecting to a waveguide fixture connector, according to some embodiments, wherein FIG. 3A shows a perspective view of the blind mate waveguide flange connected to a waveguide fixture connector, FIG. 3B shows an exploded view of FIG. 3A, and FIG. 3C shows an exploded view of the blind mate waveguide flange and examples of connection components.

DETAILED DESCRIPTION OF THE INVENTION

Figure 1:
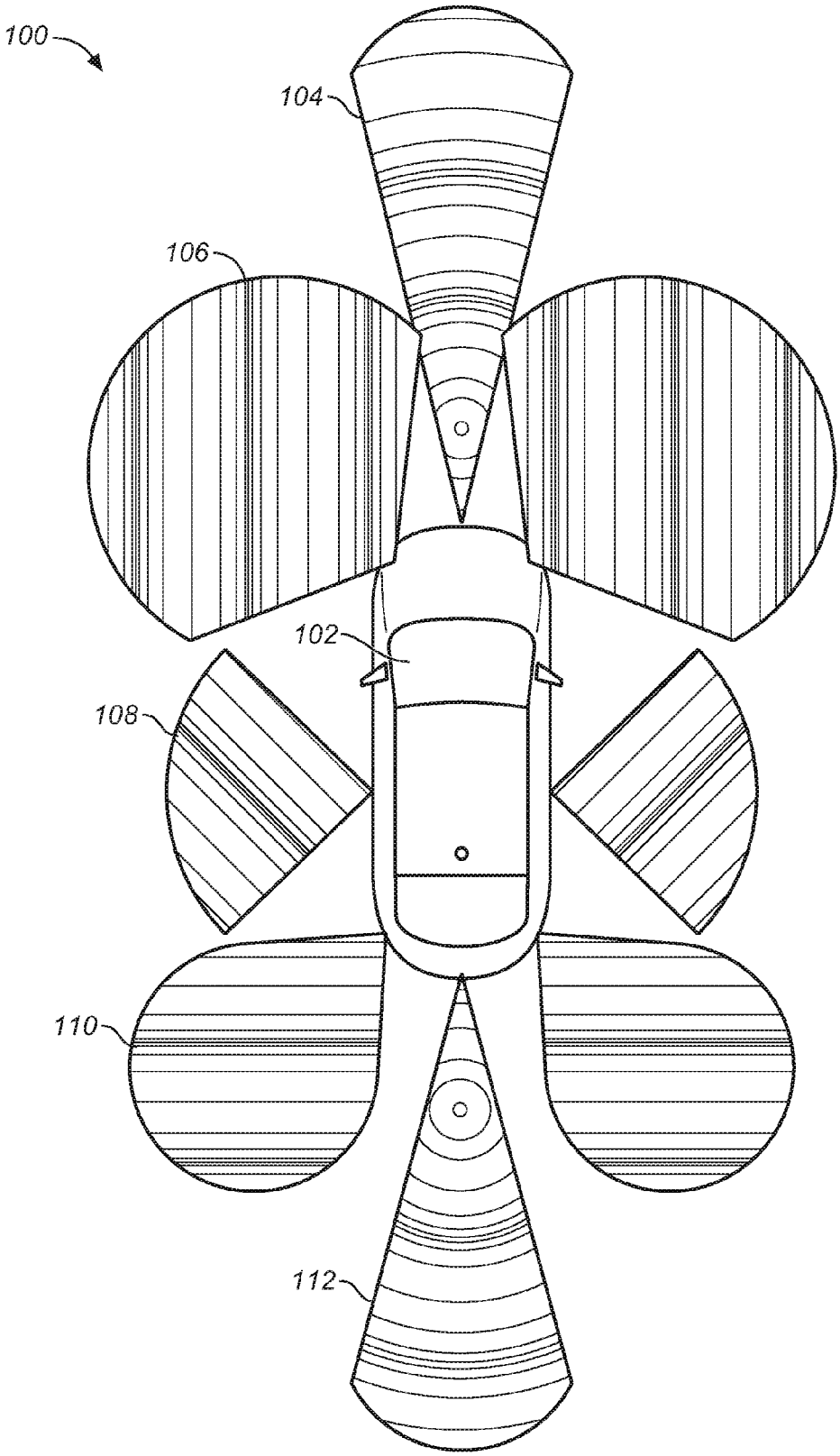
FIG. 1 is schematic top view of an automobile equipped with a plurality of radar detectors for detection, control, protection, and warning, according to some embodiments.

The following Detailed Description is merely provided by way of example and not of limitation. Furthermore, there is no intention to be bound by any expressed or implied theory presented in the preceding background or in the following Detailed Description.

Reference will now be made in detail to various embodiments of the subject matter, examples of which are illustrated in the accompanying drawings. While various embodiments are discussed herein, it will be understood that they are not intended to limit to these embodiments. On the contrary, the presented embodiments are intended to cover alternatives, modifications and equivalents, which may be included within the spirit and scope the various embodiments as defined by the appended claims. Furthermore, in this Detailed Description, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Notation and Nomenclature

Some portions of the detailed descriptions which follow are presented in terms of procedures, logic blocks, processing and other symbolic representations of operations on data within an electrical device. These descriptions and representations are the means used by those skilled in the data processing arts to most effectively convey the substance of their work to others skilled in the art. In the present application, a procedure, logic block, process, or the like, is conceived to be one or more self-consistent procedures or instructions leading to a desired result. The procedures are those requiring physical manipulations of physical quantities. Usually, although not necessarily, these quantities take the form of high frequency (e.g., millimeter or microwave) signals capable of being transmitted and received by an electronic device and/or electrical or magnetic signals capable of being stored, transferred, combined, compared, and otherwise manipulated in an electrical device.

It should be borne in mind, however, that all of these and similar terms are to be associated with the appropriate physical quantities and are merely convenient labels applied to these quantities. Unless specifically stated otherwise as apparent from the following discussions, it is appreciated that throughout the description of embodiments, discussions utilizing terms such as "interfacing," "connecting," "testing," "receiving," "introducing," or the like, refer to the actions and processes of an electronic device such as an electrical device.

As used herein, a blind mate connector is differentiated from other types of connectors by the mating action that happens via a sliding or snapping action which can be accomplished without wrenches or other tools. They have self-aligning features which allows a small misalignment when mating.

As used herein, a choke flange is used in a choke connection, which is formed by mating one choke flange and one cover (or gasket/cover) flange or by mating one choke flange to another choke flange. The central region of the choke flange face is very slightly recessed so that it does not touch the face of the cover flange, but is separated from it by a narrow gap. The recessed region is bounded by a deep choke trench (or ditch or groove) cut into the face of the flange.

It is be noted that, as used in this specification and the appended claims, the singular forms "a," "an," and "the" include plural referents unless the context clearly dictates otherwise. It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Overview of Discussion

In recent years, radar capability has been added to motor vehicles, such as for adaptive cruise control (ACC) and forward collision warning (FCW). The radar frequency is typically in the 60 GigaHertz (GHz) to 90 GHz range, most commonly in the 71 GHz to 86 GHz region. The corresponding range in terms of wavelength is 5.0 millimeters (mm) to 3.33 mm and the corresponding region in terms of wavelength is 4.22 mm to 3.49 mm.

Testing of chipsets for automotive use has been relatively simple with only one or two radar inputs. However, more recently, additional radar inputs have been provided to motor vehicles, such as blind spot detection (BSD), rear collision protection (RCP), lane change assist (LCA), and cross traffic alert (CTA). While some of the radar inputs cover only front or rear, and thus only need one radar detector, others, such as BSD, CTA, and LCA, require two (one per side). It will be appreciated that such radar detection schemes can require six, or eight, or even more radar detectors.

FIG. 1 is an example schematic diagram of a radar system 100 for a motor vehicle 102. In the example shown, ACC and FWC 104 provide two separate inputs, but essentially one beam. CTA (two each) 106, BSD (two each) 108, LCA (two each) 110, and RCP 112 provide additional radar inputs.

Testing a chipset for one or two radar inputs does not impose much of a requirement for space for the radar waveguide connectors to the chipset. However, with an increasing number of radar inputs, there is simply not enough room for the presently-used UG-387/U flange, which is employed with WR12 waveguides, which are capable of transmitting millimeter waves in the region of 60 to 90 GHz.

Figure 2A:
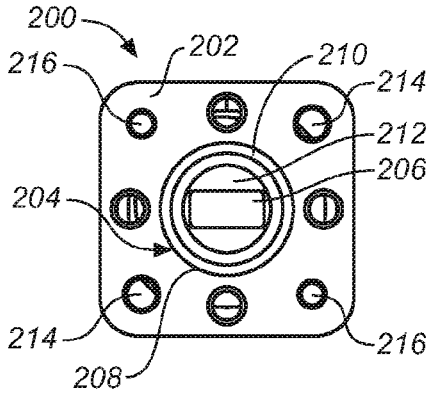

In accordance with principles disclosed herein, a blind mate waveguide flange is provided. FIGS. 2A-2D provide various views of the blind mate waveguide flange 200. As depicted in FIG. 2A, the blind mate waveguide flange 200 comprises a surface 202 for interfacing with elements of a waveguide fixture connector or a waveguide fixture (see, e.g., FIGS. 4 and 5). The surface 202 comprises a choke flange 204 and a first opening 206 to one end 222 of a waveguide transition section 220 (seen in FIG. 2B). The choke flange 204 comprises a choke groove 208 separating a peripheral region 210 from an inner region 212 of the mating surface. The inner region 212 is recessed relative to the peripheral region 210 to provide an air gap upon mating with another mating surface (e.g., another blind mate waveguide flange or an opening on a probe card holder). It should be appreciated that the distance of the recess can be any length, so long as inner region 212 is not flush with a mating surface (e.g., the distance of the recess is greater than zero). In one embodiment, the recess is equivalent to a fraction of a wavelength carried through the waveguide (e.g., 100 μm-200 μm). The first opening 206 has a first shape, such as rectangular.

The choke flange 204 avoids having to screw the waveguide flange to another waveguide flange, since screws to attach the waveguide to the chipset cannot work at such a density of waveguide flanges. The choke flange 204 also avoids the need for perfect alignment and thereby relaxation of tolerances.

Figure 2B:
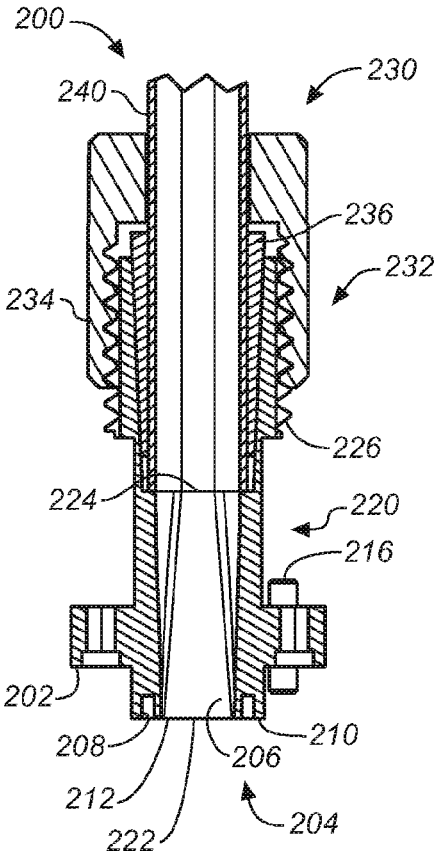
Figure 2C:
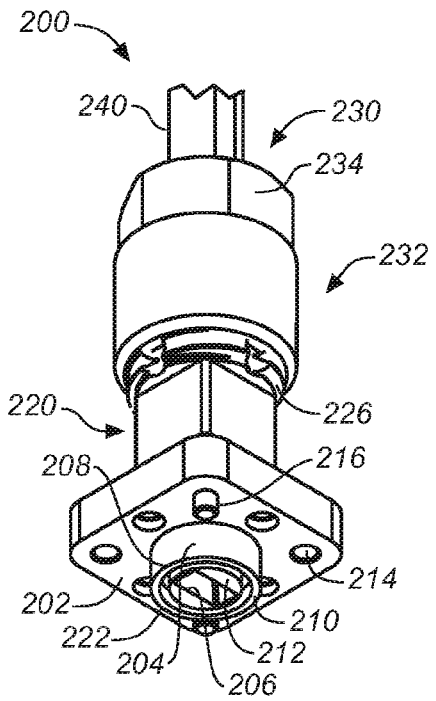
Figure 2D:
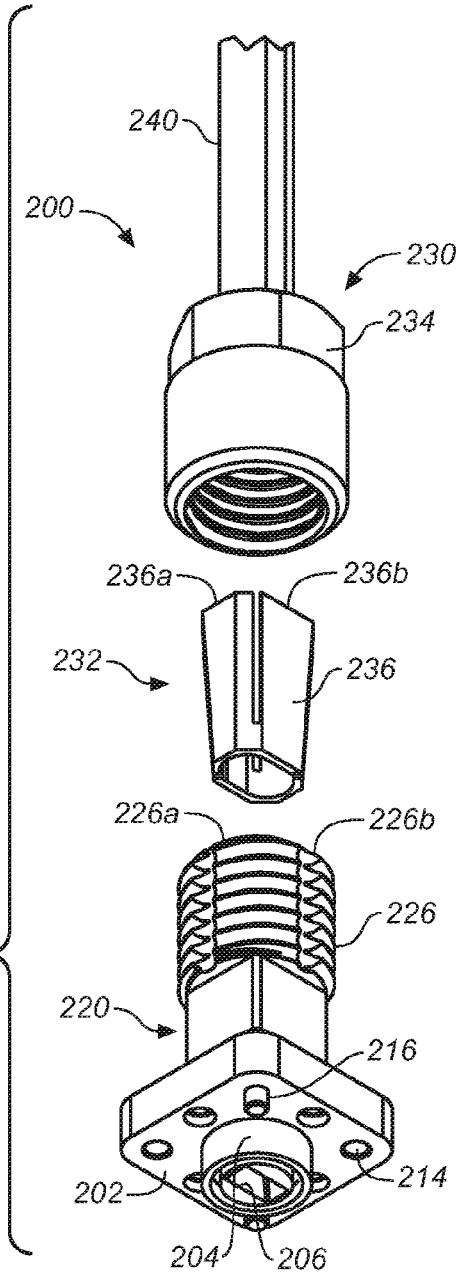
Figure 2E:
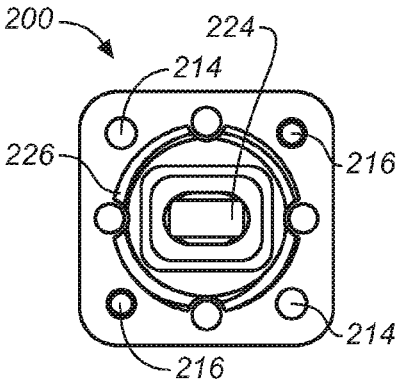

As better seen in FIGS. 2B-2C and 2E, the blind mate waveguide flange 200 further includes a waveguide connection interface 230 (FIGS. 2B and 2C) comprising a second opening 224 at an opposite end of the waveguide transition section 220 for interfacing with a waveguide 240. The second opening 224 (FIG. 2B) has a second shape, such as oval, such that the waveguide transition section 220 provides a transition from the first shape to the second shape.

The waveguide connection interface 230 further comprises a compression fitting 232 for connecting the blind mate waveguide flange 200 to the waveguide 240. An example of a suitable compression fitting 232 includes a nut 234 threadably secured to the opposite end having the second opening 224 at threaded surface 226, and including a ferrule 236 (FIG. 2B) surrounding the waveguide 240 near its attachment to the waveguide connection interface 230.

FIG. 2D is an exploded view of the blind mate waveguide flange 200 and waveguide 240 shown in FIGS. 2B-2C, showing interlocking of the ferrule 236 within a region of blind mate waveguide flange 200 having a threaded surface 226 for receiving the nut 234. Tabs 236*a* and 236*b* on the ferrule 236 provide the interlocking via slots 226*a* and 226*b* within the region of blind mate waveguide flange 200 having the threaded surface 226.

As indicated above, and as illustrated in FIGS. 2A and 2E. the first shape of the first opening 206 (FIG. 2A) may be rectangular, while the second shape of the second opening 224 (FIG. 2E) may be oval, such that the waveguide transition section provides a rectangular-to-oval transition. The second opening 224 may be oval to accommodate an oval cross-section of the waveguide 240. In some embodiments, the waveguide 240 may be of a non-corrugated oval cross-section and is easily bendable so that it can be hand-formed on-site. It should be appreciated that waveguides having an oval cross-section are more easily bendable than waveguides having a rectangular or square cross-section, as the latter are more likely to kink or deform, impacting the ability of the waveguide to transmit signals. Moreover, it should be appreciated that waveguide 240 can be manufactured using a variety of materials, such as and without limitation: aluminum, copper, metal-plated plastic, etc.

In accordance with various embodiments, there are openings or holes 214 through the surface 202. It will be appreciated that these openings 214 are for providing interoperability with other components, such as a waveguide fixture or a waveguide fixture connector. Thus, the surface 202 is for interfacing with the surface of an element of the waveguide fixture or the waveguide fixture connector. In some embodiments, at least one opening 214 is threaded for receiving a screw. It should be appreciated that openings 214 are optional. In this connection, the surface of the element of the probe card holder may also comprise a choke flange. Further, if the need arises, the blind mate waveguide flange 200 may be mated to an RR12 flange or a UG-387/U flange. In this connection, it should be noted that the RR12 flange and the UG-387/U flange are each about 1 inch in diameter. For comparison, the blind mate waveguide flange 200 is about 0.25 inch by 0.25 inch.

While the configuration of the blind mate waveguide flange 200 may be suitable for a wide variety of millimeter-wave applications, it will be appreciated that the waveguide 240 and waveguide transition section 220 are particularly appropriate for transmitting millimeter-wave energy at 60 GHz to 100 GHz, and in some embodiments, at 76 GHz to 77 GHz.

In some embodiments, the blind mate waveguide flange 200 further comprises an anti-rotational external shape to provide alignment with a receiving mount. For example, there may be at least one alignment pin 216 for preventing rotation of the blind mate waveguide flange 200 within a probe card holder or a probe card holder connector. The alignment pin(s) 216 are visible in FIGS. 2C and 2D. For example, blind mate waveguide flange 200 may be inserted into a slot on a probe card such that alignment pins 216 align the position of blind mate waveguide flange 200 relative to the probe card. It should be appreciated that alignment pins 216 are optional.

As part of a test apparatus to test automotive radar receivers on a chipset, a plurality of the blind mate choke flanges may be mounted on either or both of a waveguide fixture and a probe card holder, which, when matingly engaged, serve as a point of connection between a test head of the apparatus and the chipset. The test head is configured to provide source, receive, measure, and signal processing capability. The probe card is configured to communicate with the radar chipset. The waveguide fixture and the probe card holder are configured to be brought together into mating contact to convey signals between the test head and the chipset for testing.

Figure 3C:
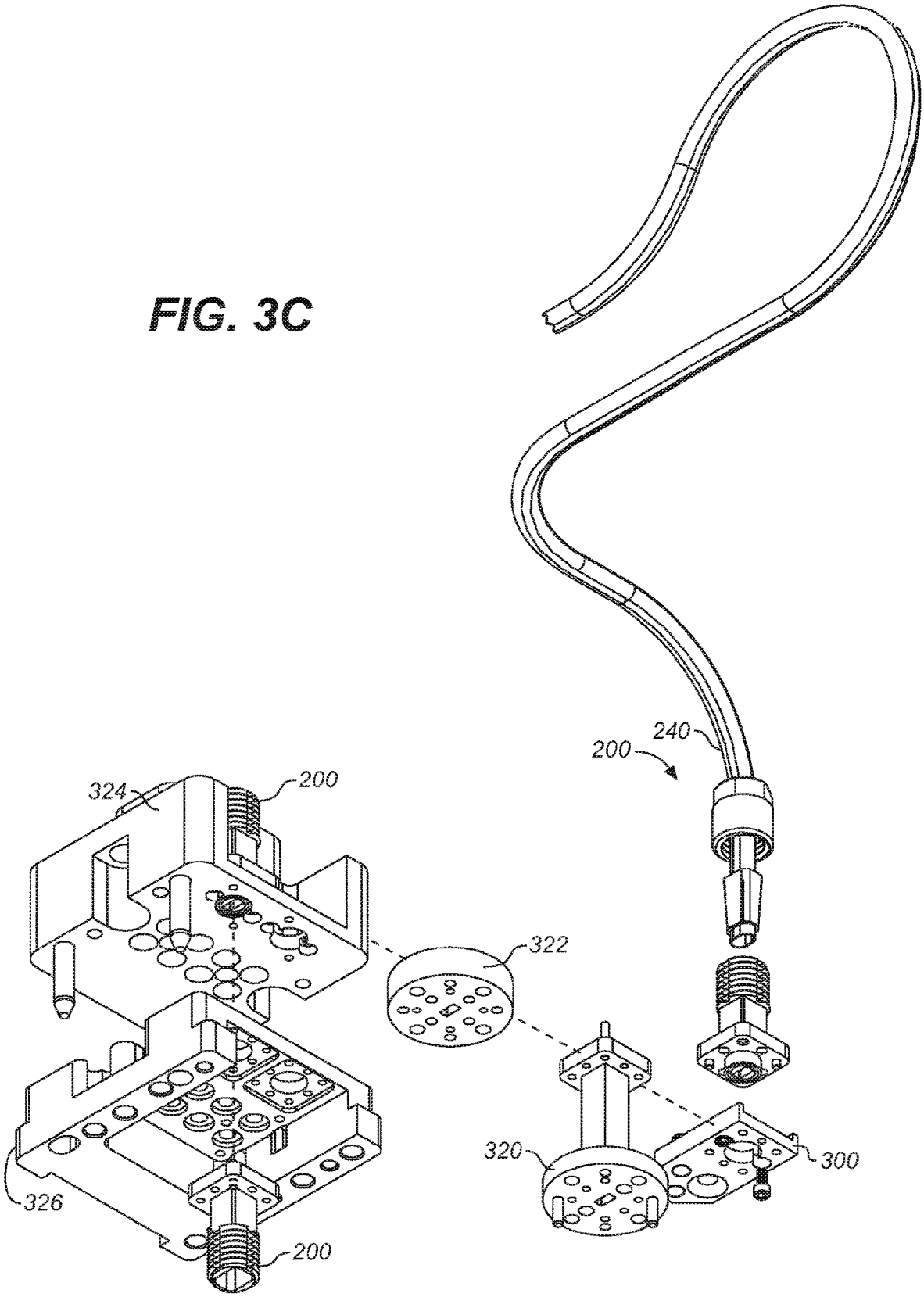

In accordance with principles disclosed herein, blind mate waveguide flange 200 may be used for connecting a waveguide 240 to a probe card holder. FIGS. 3A-3C depict views of a blind mate waveguide flange 200 connecting to a probe card holder connector, according to various embodiments. As depicted in FIGS. 3A and 3B, blind mate waveguide flange 200 is connected to a probe card holder connector 300.

Probe card holder connector 300, in accordance with various embodiments, operates as an interface for connecting blind mate waveguide flange 200 (FIG. 2B) to a probe card holder. Probe card holder connector 300 includes an opening 302 for receiving choke flange 204 of blind mate waveguide flange 200. In one embodiment, when blind mate waveguide flange 200 is inserted into opening 302, surface 202 contacts the facing surface of probe card holder connector 300 and peripheral region 210 of blind mate waveguide flange 200 is substantially flush with surface 304 of probe card holder connector 300. It should be appreciated that peripheral region 210 and surface 304 need not be perfectly flush, so long as peripheral region 210 is available for surface contact with an opposing waveguide interface.

In some embodiments, probe card holder connector 300 may optionally include openings 306 for interfacing with pins 216 and/or pins for interfacing with openings 214 for aligning first opening 206 relative to probe card holder connector 300. In some embodiments, probe card holder connector 300 includes opening 308 for receiving screw 310 that interfaces with a threaded opening 214 of blind mate waveguide flange 200 (FIG. 2B). In some embodiments, probe card holder connector 300 includes a groove 312 for receiving gasket 314 (e.g., a rubber gasket or O-ring). In some embodiments, probe card holder connector 300 includes opening 316 and pins 318 for interfacing with a probe card holder.

FIG. 3C illustrates an exploded view of examples of other connectors for connection to blind mate waveguide flange 200. It should be appreciated that blind mate waveguide flange 200 may be connected to any type of compatible connector, such as probe card holder connector 300, extending connector 320 or connector 322. In some embodiments, two blind mate waveguide flanges 200 may be individually connected to opposing interlocking connectors 324 and 326. As illustrated in FIG. 3C, waveguide 240 is bendable to accommodate spacing and size requirements of the connecting components.

Figure 4:
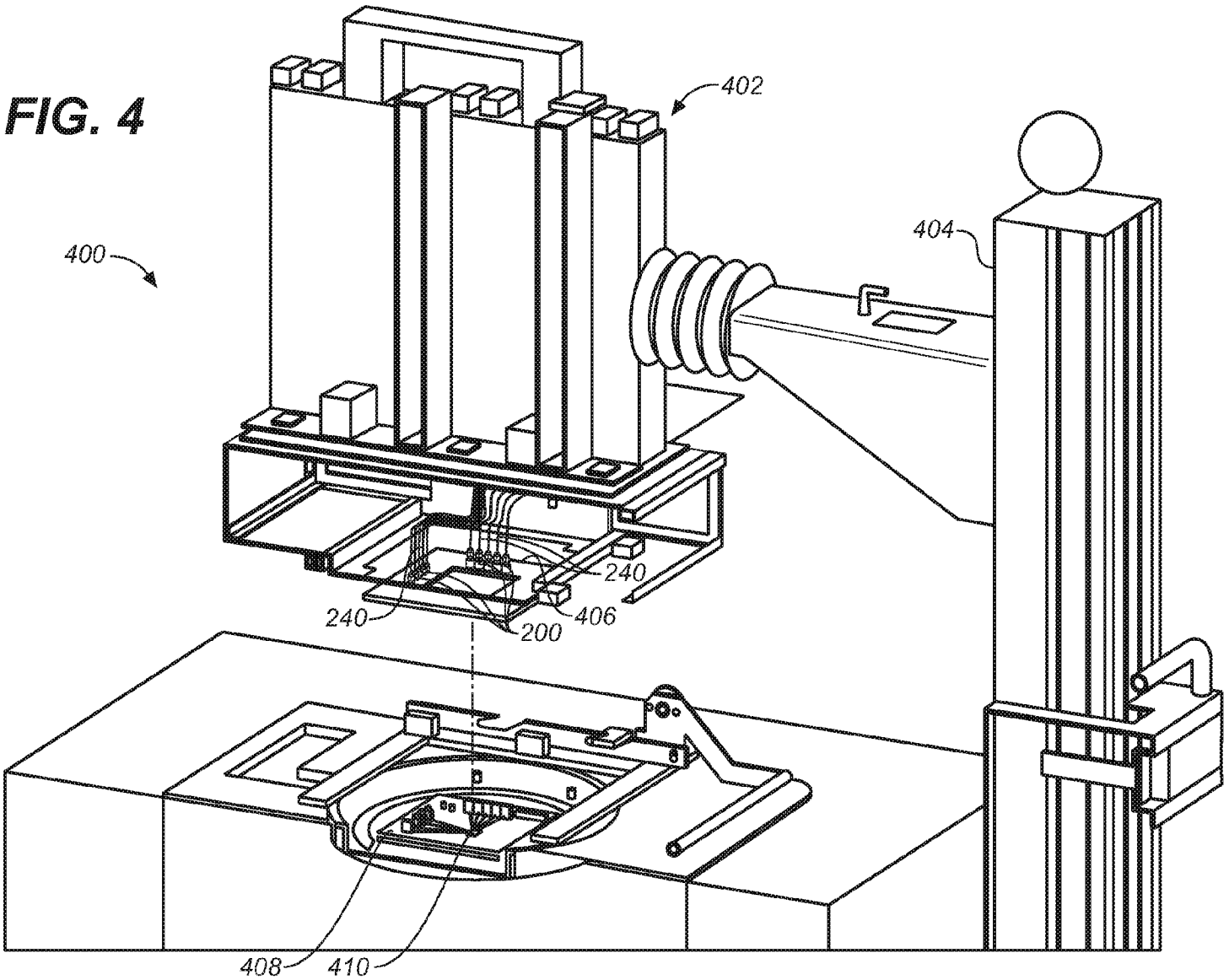
FIG. 4 is a perspective view of a portion of a test apparatus, showing a plurality of blind mate waveguide flanges mounted on at least one of a waveguide fixture and a probe card holder relative to a radar chipset to be tested, according to some embodiments.

FIG. 4 shows a portion of a test apparatus 400, including a plurality of blind mate waveguide flanges 200 coupled to waveguide fixture 406. As illustrated, test apparatus 400 includes a test head assembly 402 supported by a support arm 404 (FIG. 4). The test apparatus 400 is configured to test the radar chipset 410. The test head assembly 402 includes the waveguide fixture 406 for mating connection to the probe card holder 408. It should be appreciated that the blind mate waveguide flanges 200 may be connected to waveguide fixture 406 via waveguide fixture connectors (e.g., waveguide fixture connector 300 (FIGS. 3A-3C)). The probe card holder 408 in turn is connected to components on the radar chipset 410, including by millimeter waveguides to the radar receivers.

Figure 5:
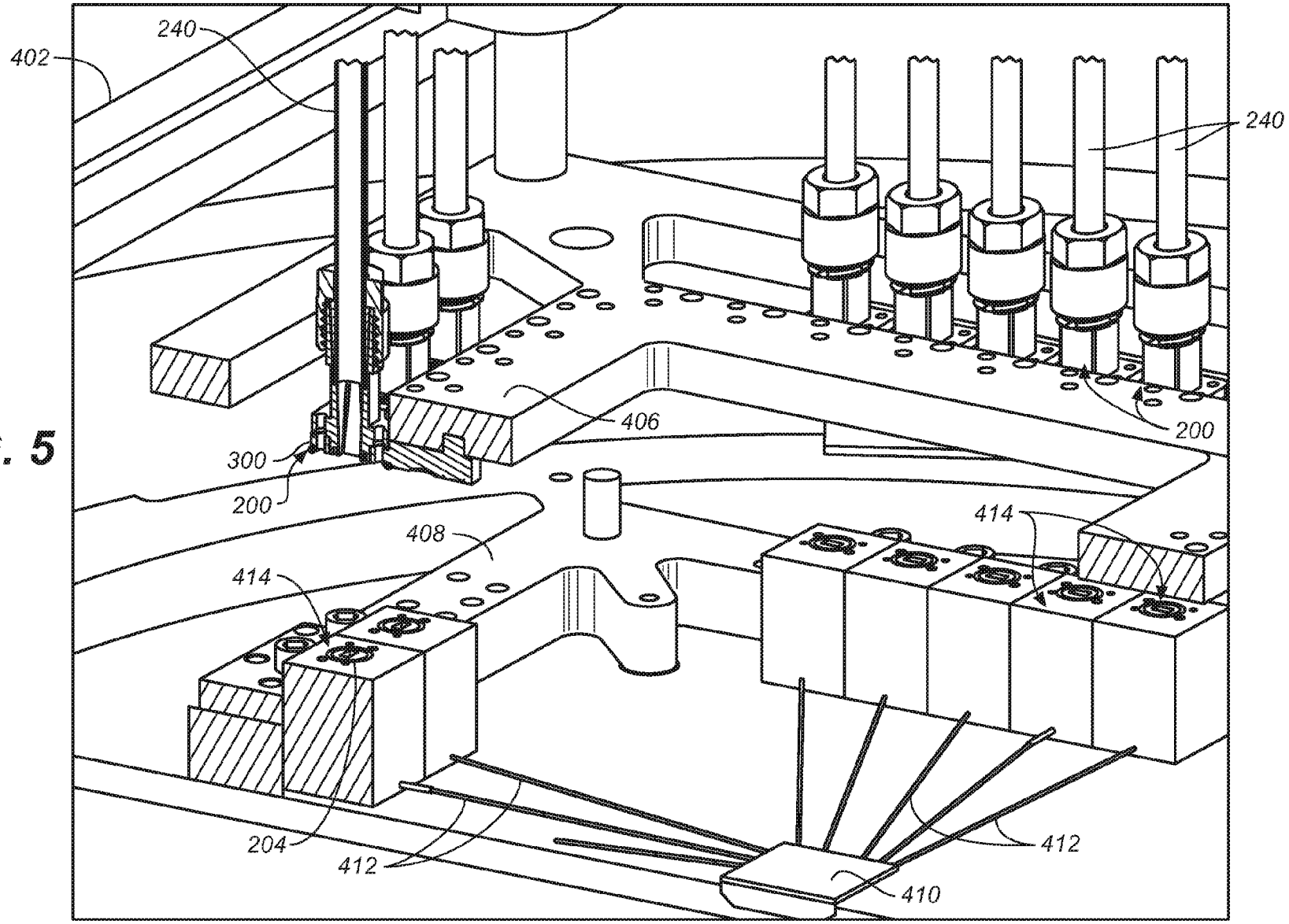
FIG. 5 is an enlarged view of a portion of the apparatus depicted in FIG. 4, showing details of the view of the waveguide fixture and the probe card holder prior to mating engagement.

FIG. 5 shows further details of the waveguide fixture 406, which is matingly connected to the test head assembly 402, the probe card holder 408, the chipset 410, and waveguides 412, such as millimeter waveguides, to the chipset 410. In one embodiment, a plurality of blind mate waveguide flanges 200 is mounted on the waveguide fixture 406. In other embodiments, a blind mate waveguide flange 200 is connected to waveguide fixture 406 via waveguide fixture connector 300. Both examples are illustrated in FIG. 5. A blind mate waveguide flange 200 may mate with a corresponding element 414 on the probe card holder 408 upon the waveguide fixture 406 interfacing with probe card holder 408. The element 414 may or may not have the choke flange 204 (FIGS. 2A-2E). Waveguides 412 are attached to the ends of elements 414 for connection to the chipset 410.

In another embodiment, the element 414 may have the choke flange and the flanges 200 being devoid of the choke flange 204.

In yet another embodiment, both the blind mate waveguide flange 200 and the element 414 have the choke flange 204.

For ease of alignment, a blind mate waveguide flange 200 may be connected to a waveguide fixture connector 300 for connection to waveguide fixture 406. Such a waveguide fixture connector 300 is shown for some of the blind mate waveguide flanges 200, with one of the receiving mounts shown in cross-section. The probe card holder 408 has a plurality of the elements 414. Elements 414 are configured to support the blind mate waveguide flange 200.

A method of using the blind mate waveguide flange 200 (FIGS, 2A-2E) includes interfacing the choke flange 204 of the blind mate waveguide flange with the waveguide probe interface (probe card holder) 408. The choke flange 204 comprises a choke groove 208 separating a peripheral region 210 from an inner region 212 of the choke flange 204. The inner region 212 is recessed relative to the peripheral region 210 to provide an air gap upon mating with another mating surface, The first opening 206 has a first shape, e.g., rectangular.

The method of using the blind mate waveguide flange 200 (FIGS. 2A-2E) further includes interfacing the waveguide connection interface 230 with one end of a waveguide 240. The waveguide connection interface 230 comprises a second opening at an opposite end of the waveguide transition section 220. The second opening has a second shape, e.g., oval, such that the waveguide transition section 220 provides a transition from the first shape to the second shape.

The method further includes connecting the waveguide 240 to a source of microwave energy in the test head assembly 402 (FIG. 4) and connecting another end of the waveguide 240 to the chipset 410 for testing.

The method further includes introducing microwave energy through the waveguide 240 to the first opening 206 of the blind mate waveguide flange 200 (FIGS. 2A-2E). The microwave energy may be within a range of 60 gigahertz to 100 gigahertz.

It is appreciated that, in the foregoing description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

While a limited number of examples have been disclosed, it should be understood that there are numerous modifications and variations therefrom. Similar or equal elements in the Figures may be indicated using the same numeral.

What is claimed is:

1. A blind mate waveguide flange comprising:

a mating surface for interfacing with a waveguide probe interface, the mating surface comprising a choke flange and a first opening to one end of a waveguide transition section, the choke flange comprising a choke groove separating a peripheral region of the mating surface from an inner region of the mating surface, wherein the inner region is recessed relative to the peripheral region to provide an air gap upon mating with another mating surface, the first opening having a first shape; and a waveguide connection interface comprising a second opening at an opposite end of the waveguide transition section for interfacing with a waveguide, the second opening having a second shape such that the waveguide transition section provides a transition from the first shape to the second shape, wherein the waveguide comprises a non-corrugated oval cross-section.

2. The blind mate waveguide flange of claim 1, wherein the waveguide connection interface further comprises a compression fitting for connecting the blind mate waveguide flange to the waveguide.

3. The blind mate waveguide flange of claim 1, wherein the first shape is rectangular and the second shape is an oval, such that the waveguide transition section provides a rectangular-to-oval transition.

4. The blind mate waveguide flange of claim 1, wherein the mating surface is for interfacing with the waveguide probe interface without requiring a screw or a pin.

5. The blind mate waveguide flange of claim 1, wherein the waveguide probe interface comprises a choke flange.

6. The blind mate waveguide flange of claim 1, the mating surface further comprising a plurality of holes in the peripheral region for providing interoperability with other components.

7. A testing apparatus configured to test a radar chipset, the testing apparatus including a waveguide fixture to communicate with a test head to provide source, receive, measure, and signal processing capability and a probe card holder to communicate with the radar chipset, the waveguide fixture and the probe card holder configured to mate into mating contact to convey signals between the test head and the radar chipset for testing, at least one of the waveguide fixture and the probe card holder including a plurality of receiving mounts, each receiving mount having a first end and a second end, each receiving mount configured to support the blind mate waveguide flange of claim 1 on the first end thereof; and each receiving mount configured to support the waveguide on the second end such that the waveguide passes through the receiving mount to the first end and engages with the waveguide connection interface.

8. The blind mate waveguide flange of claim 1, wherein the waveguide and waveguide transition section are for transmitting millimeter-wave frequencies at 60 gigahertz to 100 gigahertz.

9. The blind mate waveguide flange of claim 1, further comprising an anti-rotational external shape to provide alignment with a receiving mount.

10. A method including:

interfacing a mating surface of a blind mate waveguide flange with a waveguide probe interface, the mating surface comprising a choke flange and a first opening to one end of a waveguide transition section, the choke flange comprising a choke groove separating a peripheral region of the mating surface from an inner region of the mating surface, wherein the inner region is recessed relative to the peripheral region to provide an air gap upon mating with another mating surface, the first opening having a first shape;

interfacing a waveguide connection interface with one end of a waveguide, the waveguide connection interface comprising a second opening at an opposite end of the waveguide transition section, the second opening having a second shape such that the waveguide transition section provides a transition from the first shape to the second shape; and connecting the waveguide probe interface to a source of microwave energy in a test apparatus and connecting another end of the waveguide to a chipset for testing.

11. The method of claim 10 further including introducing microwave energy through the waveguide probe interface to the first opening.

12. The method of claim 11, wherein the microwave energy is within a range of 60 gigahertz to 100 gigahertz.

13. A testing apparatus configured to test a radar chipset, the testing apparatus including a waveguide fixture to communicate with a test head to provide source, receive, measure, and signal processing capability and a probe card holder to communicate with the radar chipset, the waveguide fixture and the probe card holder configured to be brought into mating contact to convey signals between the test head and the radar chipset for testing, at least one of the waveguide fixture and the probe card holder including a plurality of receiving mounts, each receiving mount having a first end and a second end, each receiving mount configured to support a blind mate waveguide flange on the first end, the blind mate waveguide flange comprising:

a mating surface for interfacing with a waveguide probe interface, the mating surface comprising a choke flange and a first opening to one end of a waveguide transition section, the choke flange comprising a choke groove separating a peripheral region of the mating surface from an inner region of the mating surface, wherein the inner region is recessed relative to the peripheral region to provide an air gap upon mating with another mating surface, the first opening having a first shape, and a waveguide connection interface comprising a second opening at an opposite end of the waveguide transition section for interfacing with a waveguide, the second opening having a second shape such that the waveguide transition section provides a transition from the first shape to the second shape; and each receiving mount configured support the waveguide on the second end such that the waveguide passes through the receiving mount to the first end and engages with the waveguide connection interface.

14. The testing apparatus of claim 13, wherein the waveguide probe interface comprises a choke flange.

15. The testing apparatus of claim 13, wherein the waveguide and waveguide transition section are for transmitting millimeter-wave frequencies at 60 gigahertz to 100 gigahertz.

16. The testing apparatus of claim 13, wherein the blind mate waveguide flange further comprises an anti-rotational external shape to provide alignment with the receiving mount.

17. The testing apparatus of claim 13, wherein the waveguide connection interface further comprises a compression fitting for connecting the blind mate waveguide flange to the waveguide.

18. The testing apparatus of claim 13, wherein the first shape is rectangular and the second shape is an oval, such that the waveguide transition section provides a rectangular-to-oval transition.

19. A blind mate waveguide flange comprising:

a mating surface for interfacing with a waveguide probe interface, the mating surface comprising a choke flange and a first opening to one end of a waveguide transition section, the choke flange comprising a choke groove separating a peripheral region of the mating surface from an inner region of the mating surface, wherein the inner region is recessed relative to the peripheral region to provide an air gap upon mating with another mating surface, the first opening having a first shape;

a waveguide connection interface comprising a second opening at an opposite end of the waveguide transition section for interfacing with a waveguide, the second opening having a second shape such that the waveguide transition section provides a transition from the first shape to the second shape; and an anti-rotational external shape to provide alignment with a receiving mount.

20. The blind mate waveguide flange of claim 19, wherein the waveguide and waveguide transition section are for transmitting millimeter-wave frequencies at 60 gigahertz to 100 gigahertz.

21. A testing apparatus configured to test a radar chipset, the testing apparatus including a waveguide fixture to communicate with a test head to provide source, receive, measure, and signal processing capability and a probe card holder to communicate with the radar chipset, the waveguide fixture and the probe card holder configured to mate into mating contact to convey signals between the test head and the radar chipset for testing, at least one of the waveguide fixture and the probe card holder including a plurality of receiving mounts, each receiving mount having a first end and a second end, each receiving mount configured to support the blind mate waveguide flange of claim 19 on the first end thereof; and each receiving mount configured to support the waveguide on the second end such that the waveguide passes through the receiving mount to the first end and engages with the waveguide connection interface.

22. The blind mate waveguide flange of claim 19, wherein the waveguide connection interface further comprises a compression fitting for connecting the blind mate waveguide flange to the waveguide.

23. The blind mate waveguide flange of claim 19, wherein the first shape is rectangular and the second shape is an oval, such that the waveguide transition section provides a rectangular-to-oval transition.

24. The blind mate waveguide flange of claim 19, wherein the mating surface is for interfacing with the waveguide probe interface without requiring a screw or a pin.

25. The blind mate waveguide flange of claim 19, wherein the waveguide probe interface comprises a choke flange.

26. The blind mate waveguide flange of claim 19, the mating surface further comprising a plurality of holes in the peripheral region for providing interoperability with other components.

27. The blind mate waveguide flange of claim 19, wherein the waveguide comprises a non-corrugated oval cross-section.

* * * * *